US005813796A

United States Patent [19]

Kocznar

[11] Patent Number: 5,813,796

[45] Date of Patent: Sep. 29, 1998

[54] ROADWAY BARRIER

[75] Inventor: Wolfram Kocznar, Innsbruck, Austria

[73] Assignee: Skidata Computer Gesellschaft mbH, Gartenau, Austria

[21] Appl. No.: 737,664

[22] PCT Filed: Mar. 19, 1996

[86] PCT No.: PCT/AT96/00052

§ 371 Date: Feb. 25, 1997

§ 102(e) Date: Feb. 25, 1997

[87] PCT Pub. No.: WO96/29472

PCT Pub. Date: Sep. 26, 1996

[30] Foreign Application Priority Data

Mar. 20, 1995 [AT] Austria ..... 486/95

[51] Int. Cl.[6] ..... E01F 13/00; E01F 9/00; B61L 5/16

[52] U.S. Cl. ..... 404/6; 404/9; 49/49; 246/479; 246/485

[58] Field of Search ..... 404/6, 9; 49/49; 116/28 R, 63 R; 246/473.1, 479, 482, 485; 14/50, 53

[56] References Cited

U.S. PATENT DOCUMENTS

| | | | |
|---|---|---|---|
| 3,913,717 | 10/1975 | Collins | 49/13 |
| 4,090,685 | 5/1978 | Pappas | 246/125 |
| 5,288,164 | 2/1994 | Nasatka | 404/10 |
| 5,466,088 | 11/1995 | Nasatka | 404/6 |
| 5,469,660 | 11/1995 | Tamenne | 479/192 |

FOREIGN PATENT DOCUMENTS

| | | |
|---|---|---|
| 0438364A1 | 7/1991 | European Pat. Off. . |
| 0553802A3 | 9/1993 | European Pat. Off. . |
| 2647277 | 4/1977 | Germany . |
| 3743305A1 | 6/1989 | Germany . |
| 1556157 | 11/1979 | United Kingdom . |
| 2248482 | 4/1992 | United Kingdom . |

*Primary Examiner*—Tamara L. Graysay
*Assistant Examiner*—Gary S. Hartmann
*Attorney, Agent, or Firm*—Lorusso & Loud

[57] ABSTRACT

A barrier for a roadway has an upright (1), a barrier arm (9) fitted on a horizontal drive spindle (2), a pivoting mechanism and a balancing spring (8) supporting the opening and closing movements of the barrier arm (9). The balancing spring (8) has an untensioned zero position (0) between the blocking position (S) and the open position (F) of the barrier arm (9).

26 Claims, 6 Drawing Sheets

ROADWAY BARRIER

BACKGROUND OF THE INVENTION

1. Field of the Invention

The invention concerns a barrier for a roadway, with an upright, a barrier arm on a horizontal drive spindle that can swing between a horizontal locking position and an upward-facing release position, a pivoting mechanism, and a balancing spring supporting the opening and closing of the barrier arm.

2. Description of the Prior Art

Such barriers, which can be used for an entry or exit gate in parking lots, garages, etc., can be inferred from EP-A 553 802 or DE-A 37 43 305. They have a system of balancing springs that support the barrier arm as it swings up in order to be able to reduce the capacity of the drive motor, to save counter-weights, and to have an upright that is as space-saving as possible. The screw spring used as a pressure spring in EP-A 553 802 and DE-A 37 43 305 is used for the balancing spring.

SUMMARY OF THE INVENTION

The problem of the invention is therefore to accelerate the cycle of moving the barrier (opening and closing), and it achieves this by having the balancing spring have an untensioned zero position that is between the locking position and the opening position of the barrier arm.

This makes for faster initial opening of the barrier arm supported by the balancing spring until it reaches the untensioned zero position. Over the remaining pivoting angle, the swinging movement is braked by the now opposing balancing spring. The cycle of movement is now accelerated mainly by the fact that the balancing spring also accelerates the closing of the barrier arm in the initial area up to the untensioned zero position; the visual impression of fast closing also directly inhibits the subsequent passage of another vehicle. Since the torque produced by the balancing spring opposes the loading torque of the barrier arm over a substantial part of its pivoting area, only one electric motor with a lower capacity is necessary, Depending on the design of the balancing spring, the untensioned zero position can be between 45° and 60° for a certain opening angle, or can be within a range of opening angles. In the latter case, the range can be between 30° and 40°, wherein the two ranges supported by the balancing spring represent the first and last 25° to 30° of the opening angle.

A first embodiment provides that the balancing spring be coaxial to the drive spindle. This makes it an extremely compact, easy-to-mount, low-weight structure.

Preferably, the balancing spring has an inner body that turns with the drive spindle, an outer body assigned to the upright, and an insert between the inner and outer bodies that deforms elastically when the inner body turns. Such a balancing spring is very easy to build and can be produced inexpensively. The insert is attached to the inner body and the outer body by an interlocking form in the peripheral direction. The inner and outer bodies can form, for example, roughly square bodies with equal angles that are staggered in the middle in relation to the corners. However, other non-round forms are also conceivable, for example triangular, elliptical, etc.

The body of the insert is comprised particularly of cylindrical parts corresponding to the number of corners, made of rubber for example. Thus, if square inner and outer bodies are staggered to one another, roughly four rubber rods can be provided as insert bodies in the four triangular intermediate spaces.

If the range of the opening angle covers the untensioned zero position, it can be provided that the outer body be able to pivot between two stops on the upright, wherein the pivot angle of the outer body is smaller than the opening angle of the barrier arm. A released zero position in a central angle range can also be achieved, for example, by making the inner body able to turn to the outer body in a limited way, and the insert body therefore can turn freely between two stops and can deform after resting on one of the two stops until it reaches the end position of the barrier arm.

On the other hand, when the range of action of the balancing spring has a swivel angle that is too small, at least two balancing springs can be arranged within reach. Here, one potential embodiment provides for an intermediate body between the outer body and the inner body, and a second elastically deformable insert between the middle body. The pivoting angle of the balancing spring is practically doubled in this design so that the untensioned zero position is limited to a very small range of angles.

The untensioned zero position can be assigned to a certain opening angle if the balancing spring is a screw spring or spiral spring surrounding the drive spindle, which is connected on one side to the drive spindle and on the other to the upright. In this embodiment, a rotating spring is used, and in a third embodiment, the balancing spring can also be formed by a torsion section of the drive spindle, which is held fast to the upright so it cannot turn.

Another embodiment offers a space-saving design for the roadway barrier by giving the pivoting drive self-inhibiting gears with a drive worm and a gear wheel arranged on the drive spindle, whose worm teeth extend over part of the periphery. The worm teeth are only necessary on part of the periphery, which is determined by the opening angle plus an end area on both sides that depends on the length of the drive worm. With an opening angle of 90°, for example, worm teeth of 120° to 150° suffice, for example, so that the entire angle within which the gear wheel moves is between 240° and 270°. That way the drive spindle can be placed closer to the side wall of the upright, for example.

To design such a gear, the balancing springs described in the past are not necessarily required: In designing the roadway barrier with an untensioned zero position, within the pivoting range, other gears can be used. Likewise, roadway barriers can be equipped with such gears without requiring a balancing spring with an untensioned zero position.

One preferred embodiment provides that the drive worm be on the motor drive shaft, which has an additional centrifugal mass. The additional centrifugal mass, on one hand, prevents an abrupt stop in the two end positions, and on the other hand, makes for a softer stop on the two end positions. The size of the additional pivoting mass depends on the respective circumstances and requirements.

If the barrier arm is down and there is a problem, the roadway should be able to be opened as simply as possible. One embodiment independent of the balancing spring and the gear design provides that the barrier arm have a holding flange that catches on the end of the drive spindle. The holding flange can be attached and detached preferably by giving the holding flange locking elements with radial spring action and having locking recesses on the end of the drive spindle, distributed over the periphery.

Especially in park garages, the lighting conditions are often not very good so that one preferred embodiment of the roadway barrier is characterized by the fact that the barrier arm is made of transparent material and has a lighting device inside. The arrangement of the light is naturally also not tied to the balancing spring, gear design, or removable fast attachment described but can be provided for any type of roadway barrier with a barrier arm.

One very simple embodiment provides that the lighting device has a light source arranged on the end of the drive spindle that lights up the hollow barrier arm. The barrier arm itself can therefore be taken off and remounted without a problem.

There is another independent embodiment that is also provided especially for park garages and other buildings with roadways to be blocked inside; in this one, the barrier arm has two parts jointed to one another, and the free part of the arm basically runs parallel to the barrier position when it swivels. Thus, for passenger cars a roadway with a clearance of 2 meters, for example, and a width of 2.50 meters, for example, can be closed off.

For parallel guidance of the free part of the arm, a cable pull is provided inside the first part of the barrier arm, for example. If it has only one length of cable and is therefore not acted on by pressure, another preferred embodiment provides that the parallel guidance on the turning joint of the free part of the barrier arm have a return spring. The other end of the cable is preferably guided out of the barrier arm to the outside by a cable roll in the drive spindle axis and attached to the upright.

The invention will be described in greater detail below using the Figures in the attached drawings without being limited thereto.

DETAILED DESCRIPTION OF THE INVENTION

Figure 1:
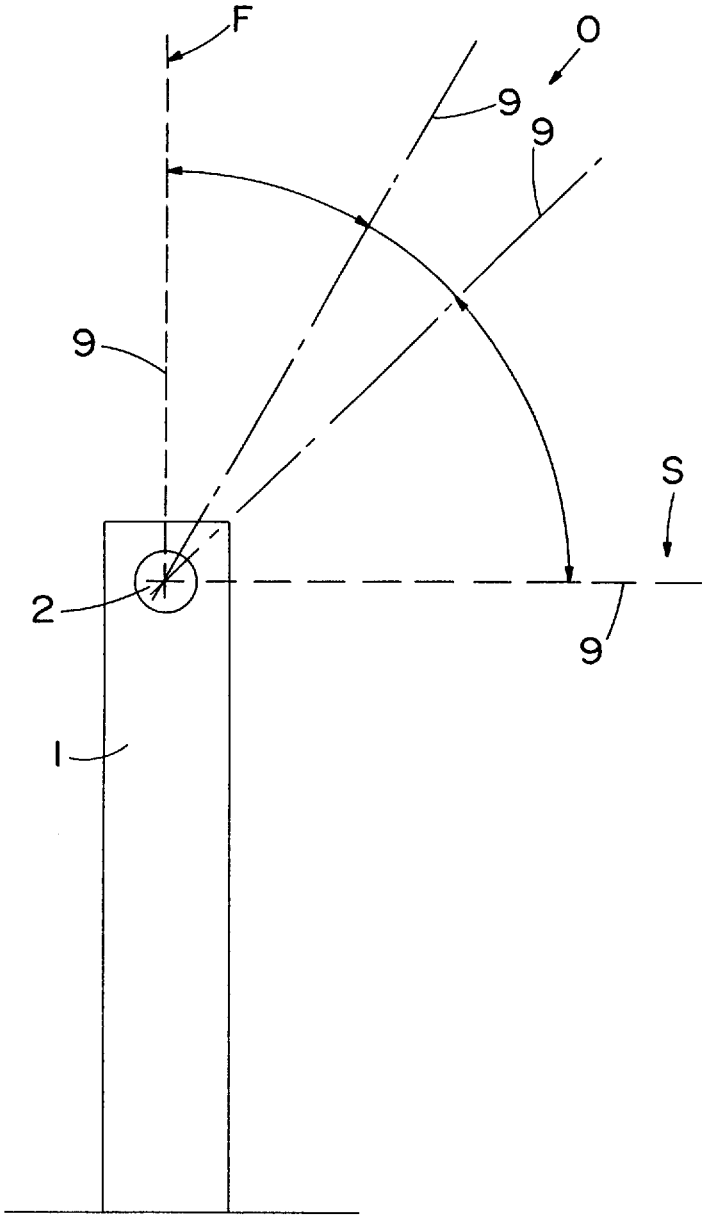
FIG. 1 shows a schematic side view of a roadway barrier.
Figure 2:
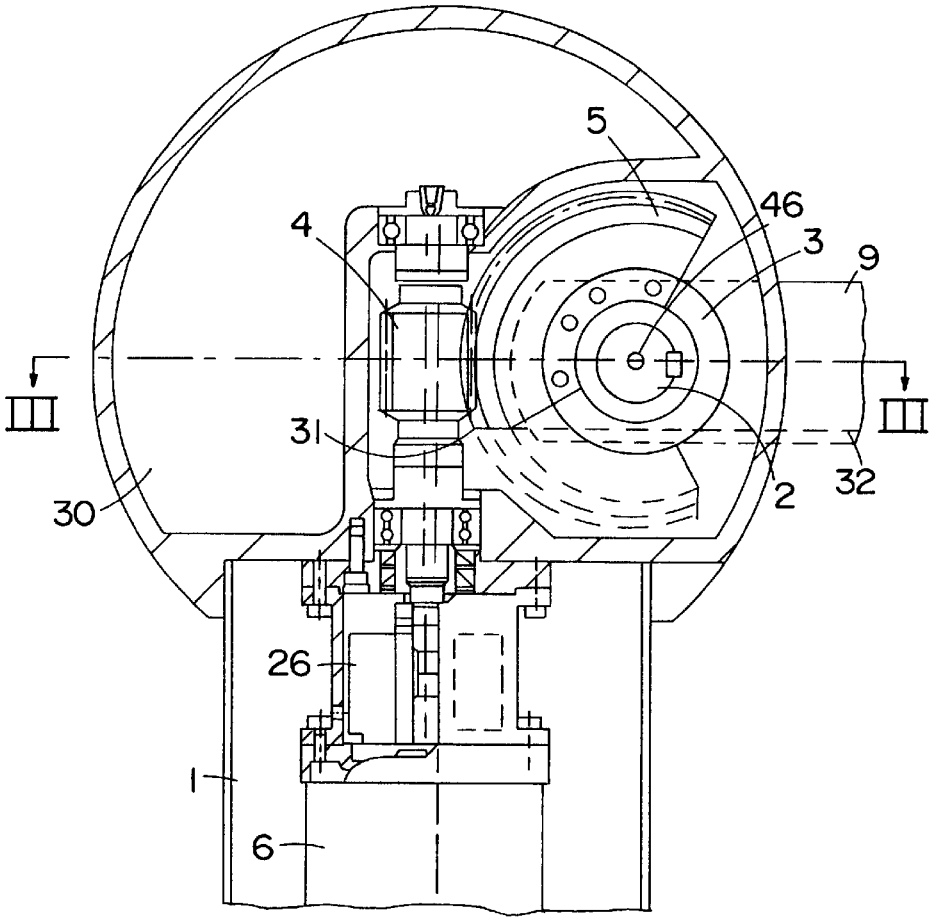
FIG. 2 shows a vertical section through the roadway barrier.

A barrier for a roadway, for example, a gate in a park garage or the like, has an upright 1 with a top 30, in which a drive spindle 2 is mounted so it can turn on bearings 7. On the end projecting out of the top 30 of the upright, the drive spindle 2 has a barrier arm 9 attached by means of a high-speed lock 12; the high-speed lock 12 allows the barrier arm 9 to be taken off if the power fails or there are other problems. A disk 13 connected to the drive spindle 2 is assigned to a sensor II for the angle of rotation. A self-inhibiting gear 25 includes a gear wheel 3 on the drive spindle 2, which has worm toothing 5 that extends only over roughly 150°. A worm 4 fits into it and is driven directly or via an intermediate gear by an electric motor 6 attached in the upright 1. An additional centrifugal mass 26 is preferably assigned to the motor 6 to make it run softly and delay stoppage.

A balancing spring 8 supporting the electric motor 6 is assigned to the drive spindle 2 so that in the untensioned zero position 0 or in the center of the untensioned zero position area, the barrier arm 9 goes up into the position shown in FIG. 1 roughly 45° to 60°. If the barrier arm 9 is moved by the electric motor 6 in its horizontal locking position S, the balancing spring 8 is tensed, which generates a torque that opposes the loading torque of the barrier arm 9. So the electric motor needs only a small drive capacity to open the closed barrier arm 9 again. The balancing spring 8 supports and accelerates the opening of the barrier arm 9 up to the untensioned zero position 0 and damps the subsequent movement in the upper end position F. Closing is accelerated and then braked by the balancing spring 8 pre-tensed in the upper end position F up to the zero position or the zero position area.

Figure 4:
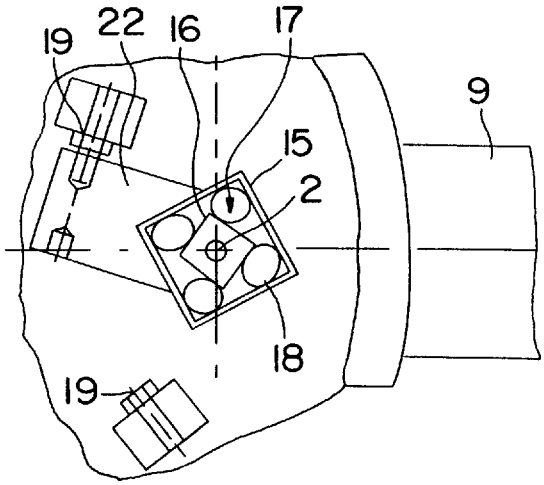
FIG. 4 and FIG. 5 show two examples of embodiments of a balancing spring in the untensioned zero position.
Figure 6:
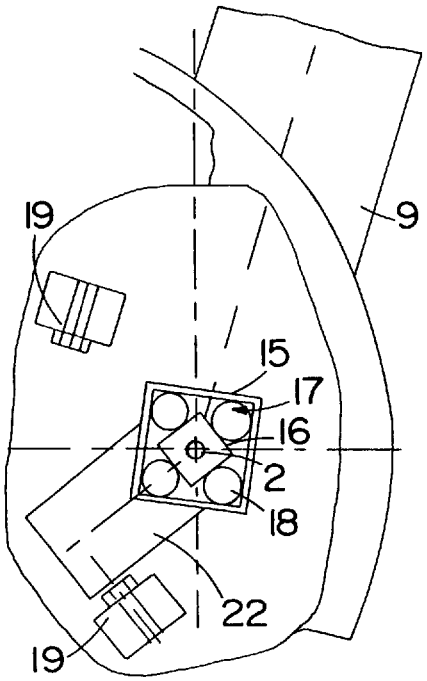
FIG. 6 shows a tensed position of the balancing spring.

In one preferred embodiment shown in detail in FIGS. 4 and 6, the balancing element 8 is composed of an inner body 16, connected to the drive spindle 2, an outer body 15 surrounding the inner body 16 and an insert 17 arranged between the two. The inner body 16 and the outer body 15 are designed to be square and are staggered 45° to one another so that in each corner of the outer body 15 a roughly triangular space is formed. The insert includes one cylindrical part 18 per corner area made of an elastically compressed material, for example, a rubber rod or the like, which in the untensioned zero position 0 of the barrier arm 9 is basically not compressed or compressed only a little in the triangular space. An extension projects from the outer body 15 and works with two stops 19 attached to the upright. The stop areas of the extension 22 have damping supports or inserts made of plastic or the like. When the drive spindle 2 is turned, the outer body 15 turns in the area of the untensioned zero position with the inner body 16 and the barrier arm 9 until the extension 22 touches one of the two stops 19. Then since only more of the inner body 16 is turned, the rubber rods 18 are squeezed and flattened, which creates a counter torque that supports the rotation back into the untensioned zero position in both directions of rotation.

Figure 5:
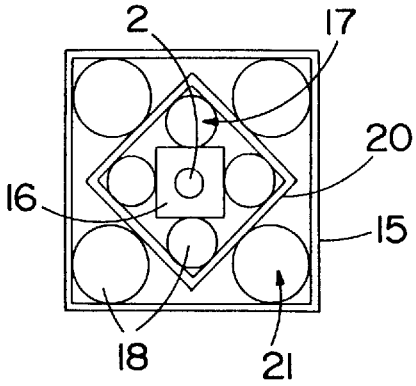

In the embodiment in FIG. 5 the balancing spring 8 has a second insert 21 and a central body 20, and the outer body 15 can be attached to the upright 1 or the top 30 of it since the angular range in which a counter torque can be produced is much greater on both sides. The zero position 0 can be set at a certain opening angle in this way.

Play in the extension 22 shown in FIG. 4 between two preferably adjustable stops 19 can also be achieved between the inner body 16 and the outer body 15 if, for example, the rubber rods 18 are somewhat smaller than the space they fit into between the bodies 15, 16, so that they are also squeezed only after a certain angle of rotation.

Figure 7:
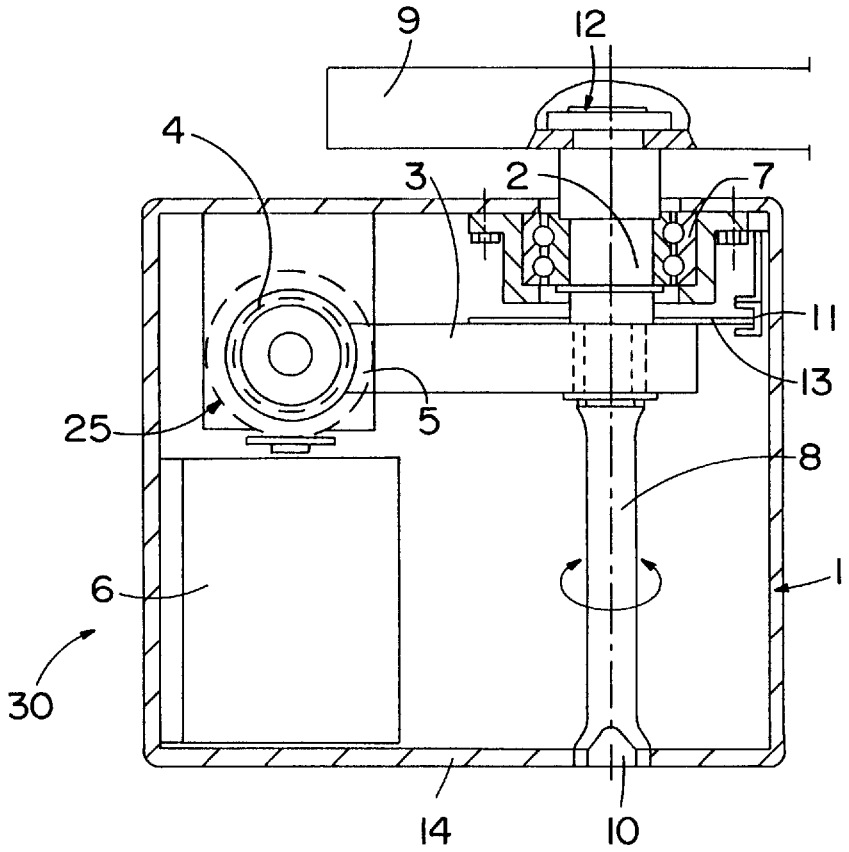
FIG. 7 shows a horizontal section through a second embodiment of the roadway barrier.

In the embodiment in FIG. 7 the balancing spring 8 is formed by the inner end section of the drive spindle 2, which is a torsion rod 10 attached or clamped to the upright 1 or its top 30. A torsion-free stop in a corresponding recess in the wall 14 of the upright is made by having the torsion rod 10 flattened on the ends. Instead of a torsion rod 10 the drive spindle 2 can also be surrounded by a screw or spiral spring as the balancing spring 8, with one end attached to the drive spindle 2 and the other end to the wall 14 of the upright.

Figure 3:
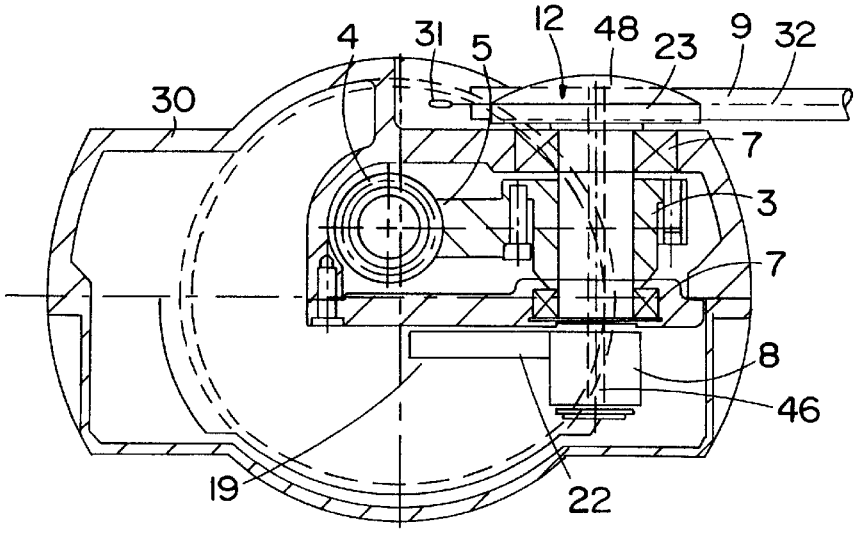
FIG. 3 shows a horizontal section along the line III—III in FIG. 2.
Figure 8:
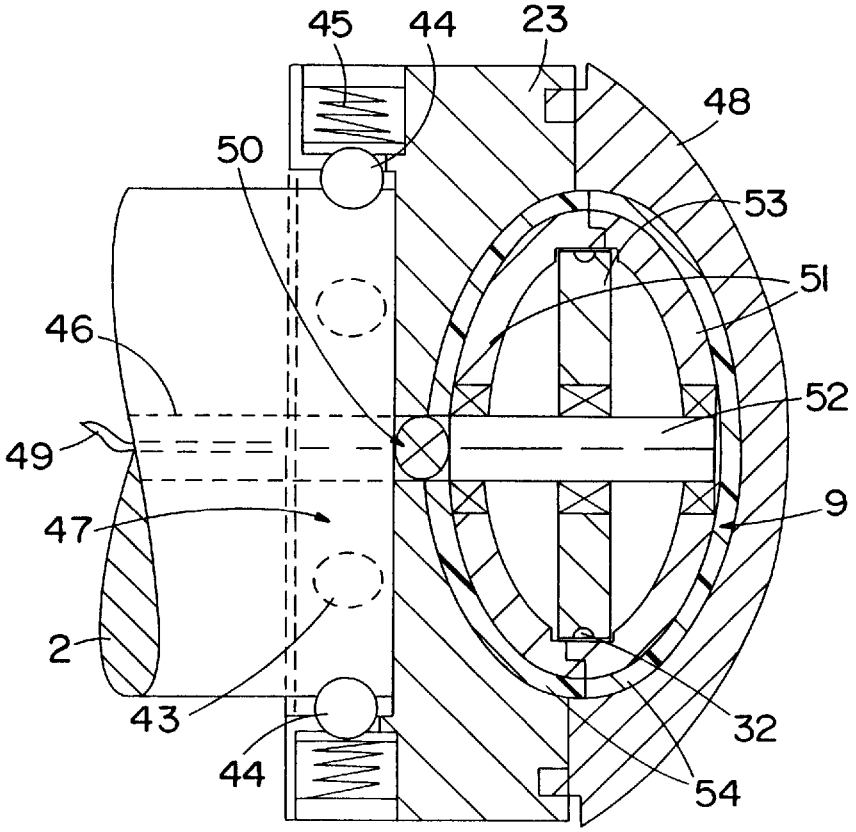
FIG. 8 shows the area where the barrier arm is attached to the drive spindle.

FIG. 8 shows an axial section through the front end 47 of the drive spindle 2 with the barrier arm 9 mounted. The barrier arm 9 is formed particularly from two half-sections 54 of non-conducting material between which there is a reinforcing, especially a two-part core 51 in the area where they are connected to the drive spindle 2. The core contains a bearing pin 52 for a cable roll 53, over which a cable 32 is run, whose end 31 comes out of the barrier arm 9, as can be seen in FIG. 3, and is attached to the top 30 of the upright or the upright 1. The two half-sections 54 are embedded in a holding flange 23 of the high-speed lock 12 and covered with a cap 48 on the outside. The holding flange 23 has a ring of interlocking elements 44, especially balls, which fit in a ring of bore holes 43 on the end 47 of the drive spindle 2, and are acted on radially to the drive spindle 2 by springs 45. The ball lock shown between the holding flange 23 and the drive spindle 2 makes it possible both to take off the barrier arm 9 easily when there are problems and to turn it when there are obstacles in its path, for example, when a vehicle is standing in the roadway. The ball lock design can also be interchanged, i.e., radial bore holes on the end 47 of the drive spindle 2 hold a spring 45 and a catch 44 to make the path of the spring longer. The accompanying locking depressions 43 are provided in this embodiment in a hardened insert ring of the holding flange 23.

The drive shaft 2 has an axial bore hole 46 so that in the middle of the holding flange 23 a lighting device 50, shown only schematically, can be placed, which lights up the barrier arm 9. The light-conducting material of the half-sections 54 make the barrier arm 9 appear as lighted bars, and the two half sections 54 can also be made in different colors. Power is supplied by a cable 49 that goes into the axial hole 46.

Figure 9:
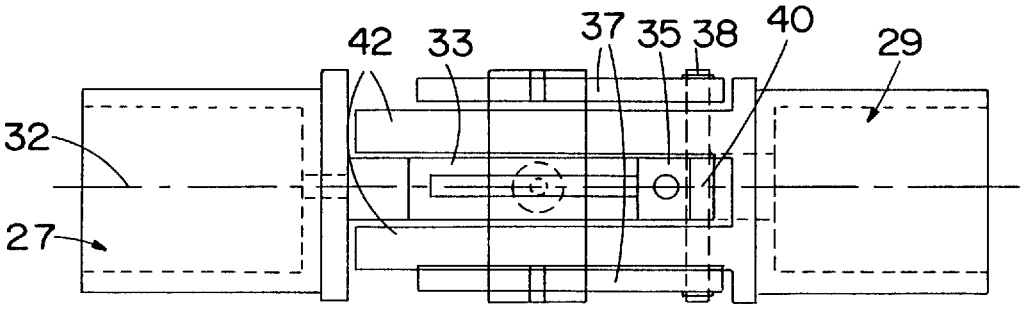
FIG. 9 and FIG. 10 show the joint in the two-piece barrier arm in top view and in longitudinal section in the locked position.
Figure 10:
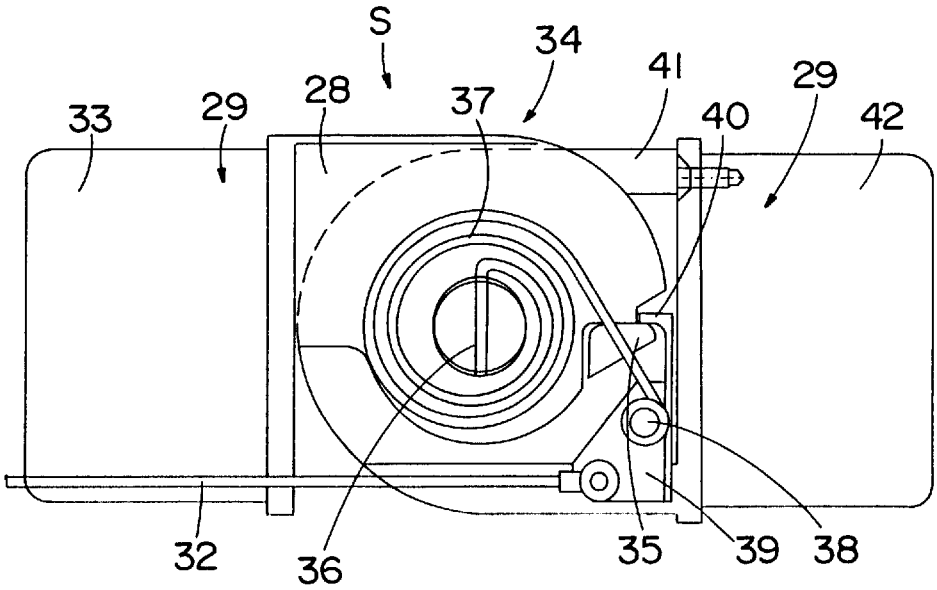
Figure 11:
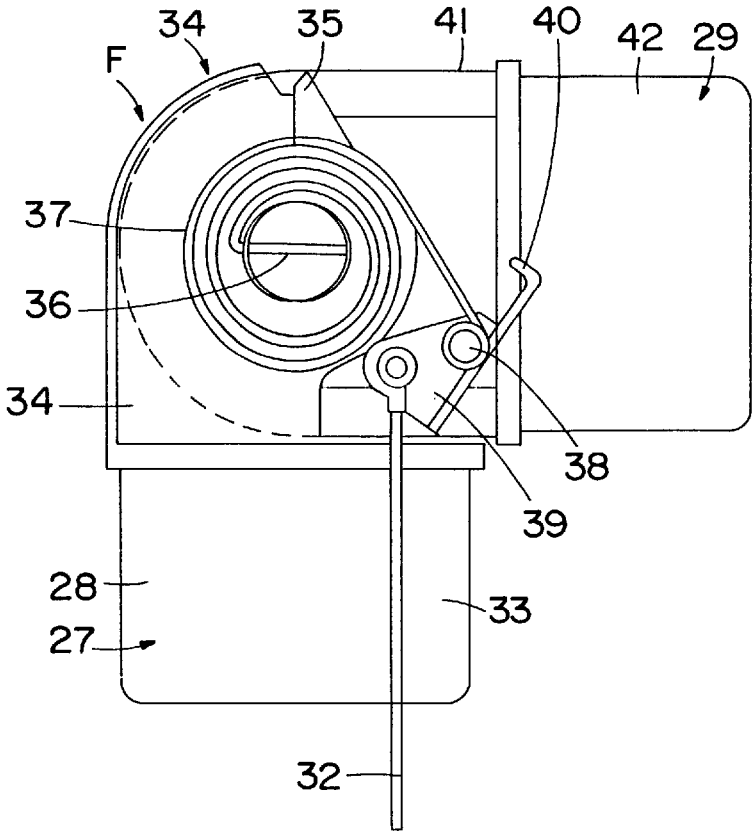
FIG. 11 shows the joint in FIG. 10 in the free position.

If the barrier arm 9 is designed to be two-piece or must be since the height available for the roadway is too small, the barrier arm 9 is preferably composed of a first part 27 that can be connected to the flange 23 of the drive spindle 2 and a free second part 29 and a joint 28, 41 in between. When the barrier arm 9 is opened from the locked position S (FIGS. 9, 10) in the free position F (FIG. 11), the free part 29 moves up roughly parallel to the horizontal locked position; i.e., during the opening it folds forward on the first part 27. This happens via a parallel guide with the cable 32 running inside the first part 27. One end 31 of the cable 32 is attached to the upright 1 or the top 30 of the upright, and the other end is connected to a locking lever 39, which can pivot around a bearing hook 38 of the joint bracket 41 on the second part 29 of the barrier arm. The lever 39 has a spring hook 40, which grasps a locking peg 35 on the joint bracket 28 of the first barrier arm 27 in the closed position 5 of the barrier arm 9. When it first opens, the barrier arm 9 swivels into the extended position until the cable 32 attached to the upright 1 has pivoted the lever 39 so far that the spring hook 40 is unlatched from the peg 35. This is the case with an opening angle of a few degrees. From there, a spring or pair of springs 37 holds the cable 32 with increasing tension; on one side, the springs are hung in a slot 36 on the joint bracket 28 on the first part 27 of the barrier arm and, on the other side, in the bearing bolts 38 on the second part 29 of the barrier arm, so that the cable 32 is acted on by tension and makes the second part 29 of the barrier arm run basically horizontally into the free position F (FIG. 9, FIG. 11). The slots 36 are preferably on the front of the joint bolt, which is attached in the joint bracket 28. If the barrier arm 9 is closed, the spring 37 holds the cable 32 tension upright, and puts the free part 29 of the barrier arm back in the same parallel position until the spring hook 40 catches behind the peg 35 in the locked position S. The spring 37 also exerts a return torque, so that it at least reduces the load torque on the second part 29 of the barrier arm.

The joint brackets 28, 41 hold a top piece 33 and 42, which can fit into the end part 27, 29 of the barrier arm. As already mentioned, part 27 of the barrier arm is sheer or transparent so that at least part 27 of the barrier arm is lighted by the lighting device 50.

I claim:

1. A barrier for a roadway, said barrier comprising:

an upright arranged beside said roadway, a swiveling drive having a drive motor and a horizontal drive spindle mounted in said upright, said drive spindle having a free end, a barrier arm carried by said free end of said drive spindle, said barrier arm being swivelable between a horizontal locked position and an upward-facing free position, and a balancing spring supporting the opening of said barrier arm, said balancing spring being coaxial to said drive spindle and having an untensioned zero position between said locked position and said free position of said barrier arm.

2. The roadway barrier according to claim 1, wherein said balancing spring has an inner body that turns with the drive spindle, an outer body assigned to the upright and an insert between the inner body and the outer body that deforms elastically when the inner body is turned.

3. The roadway barrier according to claim 2, wherein said inner body and the outer body surrounding the inner body have equal angles and are staggered in the center in relation to the corners.

4. The roadway barrier according to claim 3, wherein the inner body and the outer body are square.

5. The roadway barrier according to claim 2, wherein the outer body is attached to the upright.

6. The roadway barrier according to claim 2, wherein the outer body can swivel between two stops on the upright, and the swivel angle of the outer body is smaller than the opening angle of the barrier arm.

7. The roadway barrier according to claim 2, wherein between said outer body and said inner body there is a middle body, a first elastically deformable insert being arranged between said inner body and said middle body, and a second elastically deformable insert being arranged between said middle body and said outer body.

8. The roadway barrier according to claim 7, wherein the outer body is attached to the upright.

9. The roadway barrier according to claim 7, wherein the outer body can swivel between two stops on the upright, and the swivel angle of the outer body is smaller than the opening angle of the barrier arm.

10. The roadway barrier according to claim 1, wherein the balancing spring is a screw spring or spiral spring surrounding the drive spindle, which is connected on one side to the drive spindle and on the other to the upright.

11. The roadway barrier according to claim 1, wherein the balancing spring is formed by a torsion section of the drive spindle, which is held on the upright so it cannot turn.

12. A barrier for a roadway, said barrier comprising:

an upright arranged beside said roadway, a swiveling drive having a drive motor, a self-inhibiting gear and a horizontal drive spindle mounted in said upright, said drive spindle having a free end, said self-inhibiting gear comprising a drive worm driven by said drive motor and a gear wheel mounted on said drive spindle, said gear wheel having a periphery and a worm toothing on only part of said periphery, a barrier arm carried by said free end of said drive spindle, said barrier arm being swivelable between a horizontal locked position and an upward-facing free position, and a balancing spring supporting the opening of said barrier arm.

13. The barrier according to claim 12, wherein said balancing spring is coaxial to said drive spindle and has an intentioned zero position between said locked position and said free position of said barrier arm.

14. The barrier according to claim 12, wherein the worm toothing extends over an angle between 120° and 150°.

15. The barrier according to claim 12, wherein the drive worm is arranged on the motor drive shaft, which has an additional centrifugal mass.

16. A barrier arm for a roadway, said barrier comprising:

an upright arranged beside said roadway, a swiveling drive having a drive motor and a horizontal drive spindle mounted in said upright, said drive spindle having a free end, and a barrier arm carried by said free end of said drive spindle, said barrier arm being swivelable between a horizontal locked position and an upward-facing free position, said barrier arm having a holding flange locking on said free end of said drive spindle.

17. The barrier according to claim 16, wherein a balancing spring supporting the opening of said barrier arm is coaxial to said drive spindle and has an untensioned zero position between said locked position and said free position of said barrier arm.

18. The barrier according to claim 16, wherein the holding flange has locking elements that have radial spring action, and on the end of the drive spindle have locking recesses distributed over the periphery.

19. A barrier for a roadway, said barrier comprising:

an upright arranged beside said roadway, a swiveling drive having a drive motor and a horizontal drive spindle mounted in said upright, said drive spindle having a free end, and a barrier arm carried by said free end of said drive spindle, said barrier arm being swivelable between a horizontal locked position and an upward-facing free position, part hingedly connected to a second part, said first part of said barrier arm being arranged on said free end of said drive spindle, and said second part of said barrier arm moving essentially parallel to said locking position of said barrier arm.

20. The roadway barrier according to claim 19, wherein a balancing spring supporting the opening of said barrier arm is coaxial to said drive spindle and has an untensioned zero position between said locked position and said free position of said barrier arm.

21. The roadway barrier according to claim 19, wherein a parallel guide moving said second part of the barrier arm includes a cable pull.

22. The roadway barrier according to claim 21, wherein the first part of the barrier arm is designed to be hollow and the cable pull is inside the first part of the barrier arm.

23. The roadway barrier according to claim 22, wherein said first, hollow part of the barrier arm is made of transparent material and has an inner lighting device.

24. The roadway barrier according to claim 23, wherein the lighting device has a light source on the end of the drive spindle.

25. The roadway barrier according to claim 21, wherein the parallel guide has a cable and a return spring on the turning joint of the free part of the barrier arm.

26. The roadway barrier according to claim 25, wherein the end of the cable runs over a cable roll in the axis of the drive spindle and out of the barrier arm to the outside and is attached to the upright.

* * * * *

UNITED STATES PATENT AND TRADEMARK OFFICE

CERTIFICATE OF CORRECTION

PATENT NO. : 5,813,796

DATED : 09/29/98

INVENTOR(S) : KOCZNAR, Wolfram

It is certified that error appears in the above-identified patent and that said Letters Patent is hereby corrected as shown below:

Column 7, line 28, claim 19: cancel beginning with "19. A barrier for a roadway, said barrier comprising:" to and including "said locking position of said barrier arm." in column 8, line 7, and insert the following claim:

19.A barrier for a roadway, said barrier comprising:
an upright arranged beside said roadway,
a swiveling drive having a drive motor and a horizontal drive spindle mounted in said upright, said drive spindle having a free end, and a barrier arm carried by said free end of said drive spindle, said barrier arm being swivelable between a horizontal locked position and an upward-facing free position, said barrier arm having a first part hingedly connected to a second part, said first part of said barrier arm being arranged on said free end of said drive spindle, and said second part of said barrier arm moving essentially parallel to said locking position of said barrier arm.

Signed and Sealed this

Thirtieth Day of March, 1999

*Attest:*

*Attesting Officer*

Q. TODD DICKINSON

*Acting Commissioner of Patents and Trademarks*